US008814767B2

(12) United States Patent
Brodbeck

(10) Patent No.: US 8,814,767 B2
(45) Date of Patent: Aug. 26, 2014

(54) EXERCISE DEVICE AND METHOD

(76) Inventor: Ralph R. Brodbeck, Cincinnati, OH (US)

( * ) Notice: Subject to any disclaimer, the term of this patent is extended or adjusted under 35 U.S.C. 154(b) by 345 days.

(21) Appl. No.: 13/278,574

(22) Filed: Oct. 21, 2011

(65) Prior Publication Data

US 2012/0100969 A1 Apr. 26, 2012

(51) Int. Cl.

| | |
|---|---|
| ***A63B 21/00*** | (2006.01) |
| ***A63B 23/035*** | (2006.01) |
| ***A63B 22/20*** | (2006.01) |
| ***A63B 23/02*** | (2006.01) |

(52) U.S. Cl.

CPC ..... *A63B 21/143* (2013.01); *A63B 2208/0219* (2013.01); *A63B 23/0355* (2013.01); *A63B 23/03525* (2013.01); *A63B 22/20* (2013.01); *A63B 23/0211* (2013.01)

USPC ..... 482/132

(58) Field of Classification Search

CPC ..... A63B 22/20; A63B 23/0211; A63B 21/0004; A63B 2208/0219

USPC ..... 482/44–50, 92, 131–137, 139, 482/140–142, 145, 148, 126, 129, 130, 907, 482/51, 66–68, 104, 106, 121

See application file for complete search history.

(56) References Cited

U.S. PATENT DOCUMENTS

| | | | | | |
|---|---|---|---|---|---|
| 2,069,384 | A * | 2/1937 | Ogden | 482/132 |
| 3,403,906 | A * | 10/1968 | Burzenski | 482/132 |
| 3,616,794 | A * | 11/1971 | Gromala | 601/120 |
| 3,752,475 | A * | 8/1973 | Ott | 482/127 |
| 3,784,192 | A * | 1/1974 | Nutter | 482/132 |
| 5,599,260 | A * | 2/1997 | Rovinsky et al. | 482/121 |
| 5,690,594 | A * | 11/1997 | Mankovitz | 482/121 |
| 5,891,002 | A * | 4/1999 | Maki | 482/79 |
| 5,921,900 | A * | 7/1999 | Mankovitz | 482/121 |
| 6,203,476 | B1 * | 3/2001 | Wang et al. | 482/121 |
| 6,328,680 | B1 * | 12/2001 | Shifferaw | 482/132 |
| 6,544,153 | B2 * | 4/2003 | Lee | 482/136 |
| 7,175,573 | B1 * | 2/2007 | Huang | 482/110 |
| 7,387,599 | B1 * | 6/2008 | Hsu | 482/132 |
| 7,862,486 | B1 * | 1/2011 | Watson | 482/106 |
| 8,147,391 | B1 * | 4/2012 | Hill | 482/141 |
| 2002/0025894 | A1 * | 2/2002 | Fernandez | 482/140 |
| 2003/0022770 | A1 * | 1/2003 | Lee | 482/136 |
| 2003/0158023 | A1 * | 8/2003 | Yu | 482/126 |
| 2011/0143895 | A1 * | 6/2011 | Tang | 482/132 |

* cited by examiner

*Primary Examiner* — Loan H Thanh
*Assistant Examiner* — Andrew S Lo
(74) *Attorney, Agent, or Firm* — Wood, Herron & Evans, L.L.P.

(57) ABSTRACT

An exercise device of the present invention includes a beam; rods removeably affixed and extending from ends of the beam; wheels rotatably mounted on the rods; handles positioned on outer ends of the rods; and a body-part engagement device for engaging a user's hands, feet, or knees with the device. Multiple exercises that exercise various muscle groups of the human body may be performed with the exercise device.

12 Claims, 6 Drawing Sheets

EXERCISE DEVICE AND METHOD

RELATED APPLICATION

The present application claims priority to U.S. Ser. No. 61/405,318 filed Oct. 21, 2010, the disclosure of which is incorporated herein by reference in its entirety.

FIELD OF THE INVENTION

The present invention relates generally to exercise devices, and more particularly to exercise devices for exercising various parts of the human body.

BACKGROUND OF THE INVENTION

Most exercise devices perform one task and focus on a single part of the body, such as only the arms, legs, or back. Therefore, to achieve a more complete work out, a person may need to use more than one device. Such extra devices cost money and take up valuable space in a home gym, for example.

What is needed is a single exercise device that is versatile enough to exercise various parts of the body.

SUMMARY OF THE INVENTION

In one embodiment, an exercise device has a beam with first and second ends and a longitudinal axis extending through the first and second ends. First and second rods are removeably affixed to the first and second ends of the beam and extend outwardly therefrom. First and second wheels are rotatably mounted on the first and second rods, and first and second handles are positioned on outer ends of the first and second rods. At least one body-part engagement device is associated with the beam. The body-part engagement device may constitute, for example, a strap affixed to the beam to form two loops or two spaced-apart holes through the beam.

In one method for exercising using the exercise device, such as the one described above, a user kneels proximate the exercise device and grips both handles of the device with his or her hands. The user then rolls the device along a support surface, away from his or her knees so as to extend the body and reverses the motion by pulling the device back toward his or her knees.

In another method for exercising using the exercise device of the invention, a user positions at least one foot in at least one body-part engagement device and extends his or her leg to move the exercise device away from his or her body until his or her body is substantially parallel to the support surface. Alternatively, the user moves his or her hands to propel the user and the device across the support surface.

In yet another method for exercising using the exercise device of the invention, a user positions at least one foot in at least one body-part engagement device and places his or her hands on a support surface, holding the hands stationary. The user then pulls the exercise device with his or her at least one foot to draw the exercise device under his or her body and reverses the motion by using his or her foot to push the exercise device away from his or her body.

These and other features, objects, and advantages of the invention will become more readily apparent to those skilled in the art in view of the following detailed description, taken in conjunction with the accompanying drawings.

BRIEF DESCRIPTION OF THE DRAWINGS

The accompanying drawings, which are incorporated herein and constitute a part of this specification, illustrate embodiments of the invention and, together with a general description of the invention given above, and the detailed description given below, serve to explain the principles of the invention.

DETAILED DESCRIPTION OF THE INVENTION

The invention described herein is directed to an exercise device that may be used to strengthen multiple muscle groups of the human body. The exercise device 10 is shown in FIGS. 1-6. In the embodiment shown in FIG. 1, the exercise device 10 includes a beam 12 having two ends 13 and a longitudinal axis running between the two ends 13. The beam 12 is a box beam with an interior cavity 14 (see FIG. 2) extending the entire length of beam 12. Alternately, depending on the material used, the beam 12 may be constructed as a solid beam without the interior cavity 14. The beam 12 may be constructed of any suitable structural material, including but not limited to, aluminum, steel, plastic, fiberglass, wood, or composite materials. When the box beam 12 is constructed of aluminum, the wall thickness (t) is preferably approximately ⅛ inch thick. However, other wall thicknesses of the box beam 12 could be used, especially if a material other than aluminum is used. In one embodiment, the beam 12 is 17 inches long, 3 inches wide, and 1 inch tall.

Figure 1:
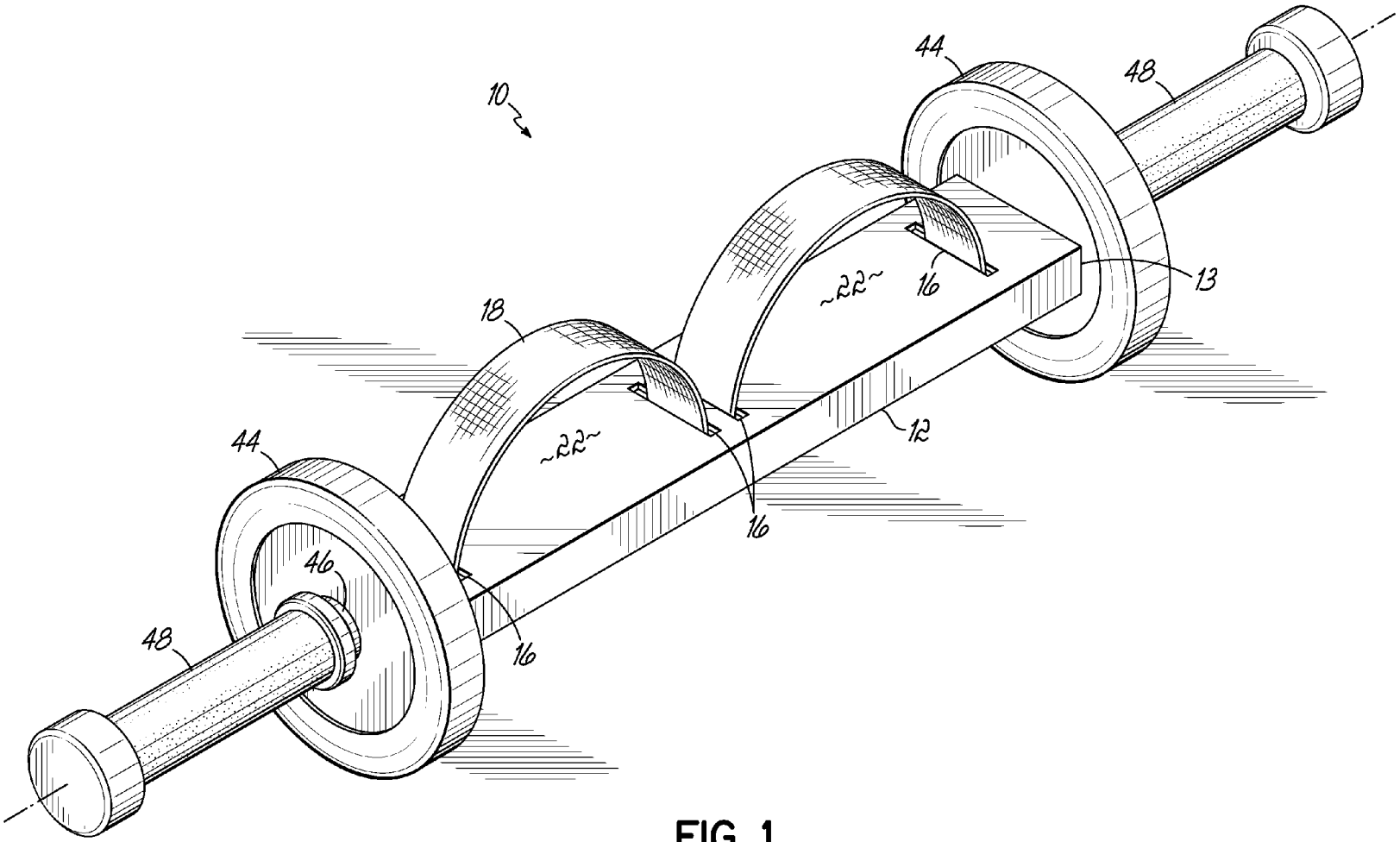
FIG. 1 is a perspective view of an exercise device in accordance with one embodiment of the present invention.
Figure 2:
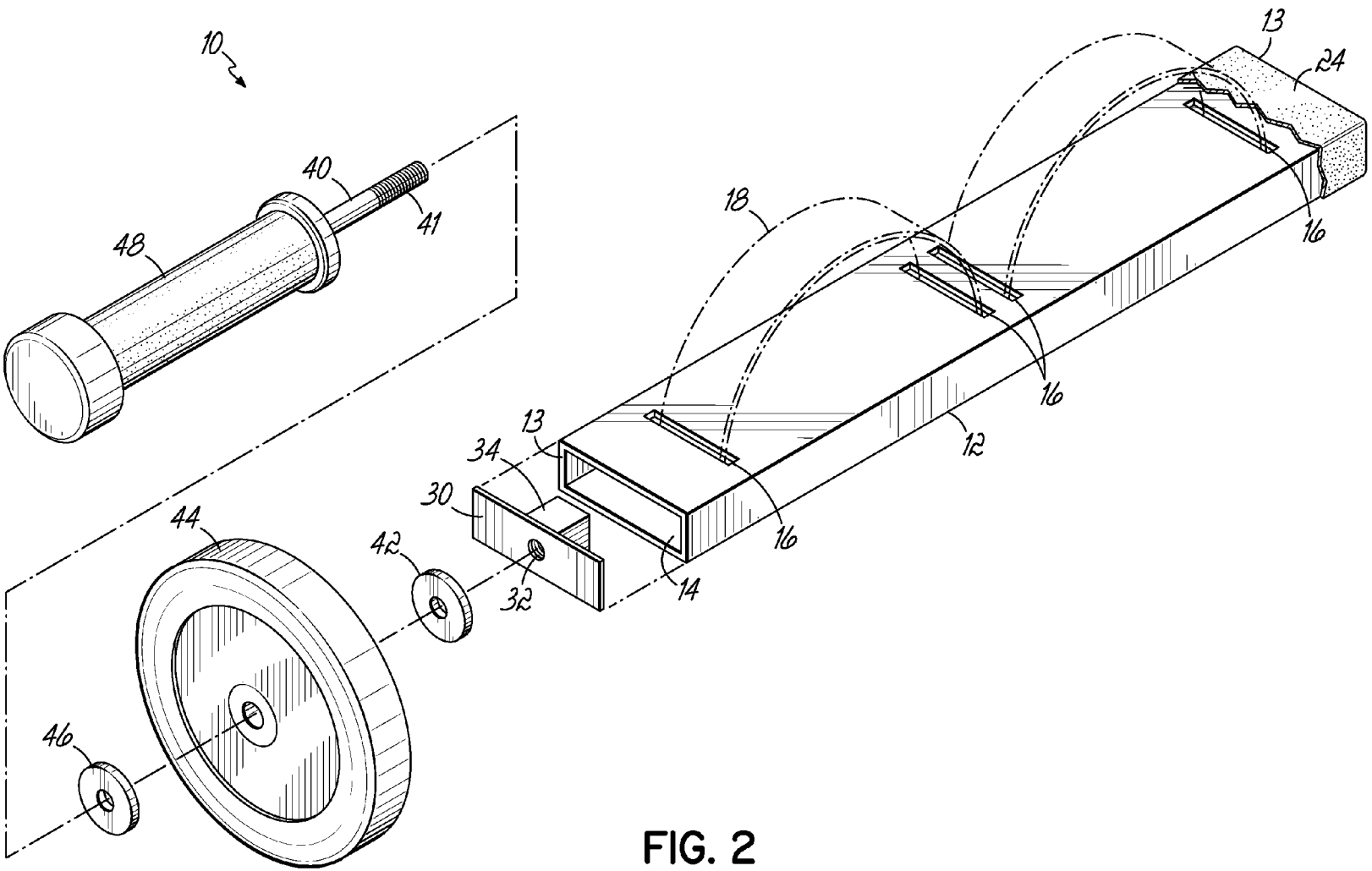
FIG. 2 is an exploded view of the exercise device of FIG. 1.
Figure 3:
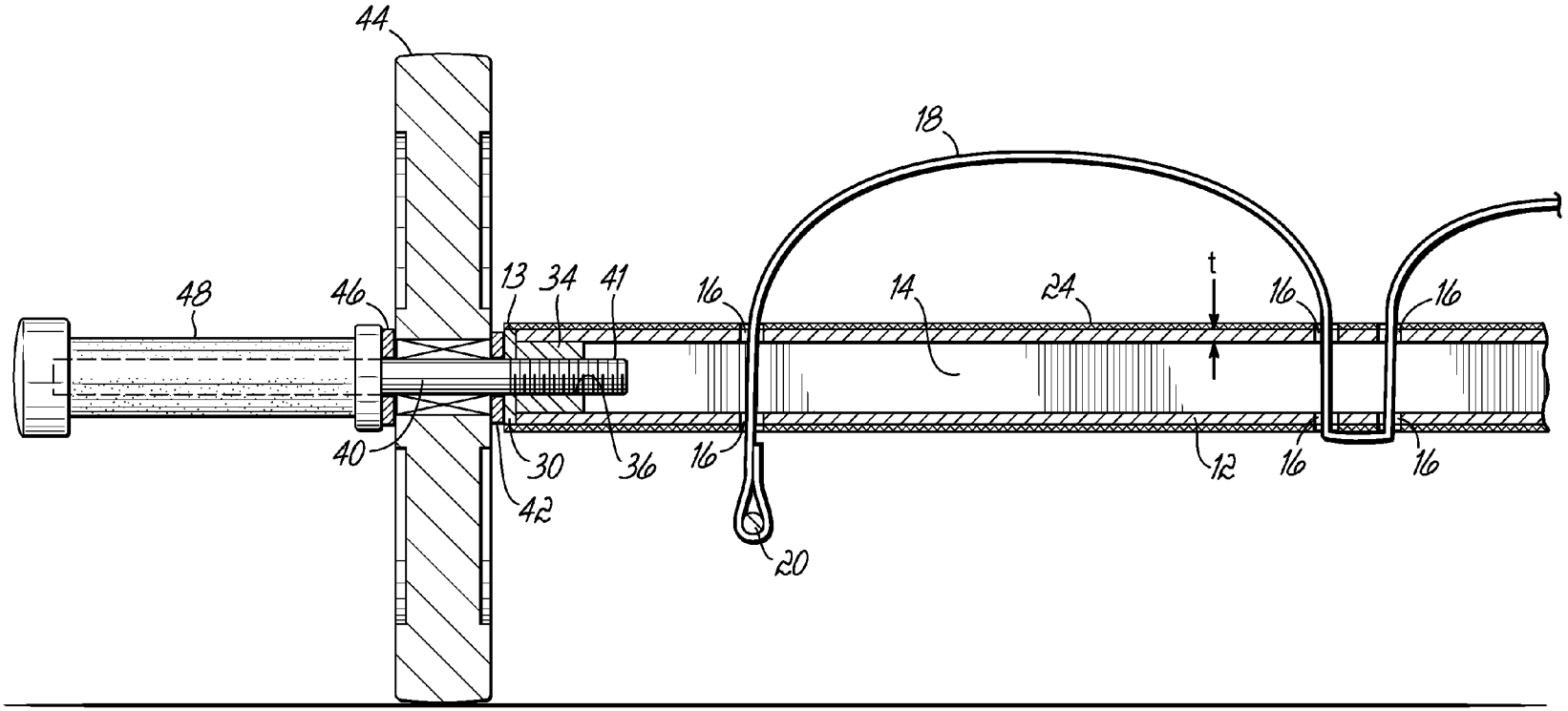
FIG. 3 is a cross-sectional view of the exercise device of FIG. 1.

A body-part engagement device is associated with the beam 12. A body-part engagement device contemplates any mechanism by which the user's body can engage or connect with an exercise device 10 such that the user may utilize the device 10 to perform exercises. In one embodiment, the body-part engagement device includes a plurality of slots 16 in the beam 12 and a strap 18, which is threaded through the slots 16, as illustrated in FIGS. 1 and 3. Although the slots 16 are shown in both a top face and a bottom face of the beam 12, the slots 16 may alternatively be included only in the top face of beam 12 or in any combination of the top and the bottom faces. A retention member 20 is attached to each end of the strap 18 to prevent the ends from being pulled through the slots 16. As shown in FIG. 1, the strap 18 forms at least two loops 22 over the top face of the beam 12. As will be explained in further detail below, the loops 22 are sized to receive and engage a user's feet with the device 10. A size of the loops 22 may be adjusted by moving more or less of the strap through the slots 16 at each end 13 of the beam 12. For example, the size of the loops 22 may be adjusted to fit around different body parts of the user or to accommodate multiple users of varying size. The retention members 20 may be used to fix the strap ends after the size of the loops 22 has been adjusted to thereby maintain the desired loop size.

A padding 24 (partially shown in FIGS. 2 and 3) may cover certain or all exterior faces of the beam 12. In particular, the padding 24 over the top surface of the beam 12 provides added comfort to the portions of the user's body that are in contact with the beam 12. The padding 24 may be constructed of rubber, fabric, or any other soft or resilient (i.e., cushioning) material. In one embodiment, the padding 24 may not be necessary if the beam 12 is formed of a relatively soft material, such as resin.

Each end 13 of the beam 12 is covered by an end plate 30 which has a through hole 32 in it. The end plate 30 may be affixed to the end 13 of the beam 12 by any conventional means, such as by welding, adhesive, or fasteners. An attachment block 34 with threaded bore 36 is affixed to end plate 30 such that through hole 32 and threaded bore 36 are coaxially aligned with one another.

A rod 40 having at least one threaded end 41 is threaded into a threaded bore 36 so as to be positioned substantially parallel to the longitudinal axis of the beam 12. In one embodiment, the rod 40 is approximately 6 inches long with a diameter of ⅜ inch. Various techniques may be used to retain the rod 40 inside the threaded bore 36, such as a thread lock, lock nuts, a cotter pin, etc. The rod 40 could have threads along its entire length, such as an all-thread rod. The rod 40 is removeably affixed to the beam 12, such that the device 10 may be assembled and disassembled, for example, for storage purposes.

A flat washer 42 is positioned on the rod 40, adjacent the end plate 30. A wheel 44 is positioned on the rod 40, proximate the flat washer 42. Another flat washer 46 is positioned on the rod 40, proximate the wheel 44. Finally, a handle 48 is positioned on an outer end of each rod 40 to hold the washers 42, 46 and the wheel 44 in place on the rod 40.

Any conventional wheel 44 may be used with the exercise device 10. The wheel 44 should have a radius that is large enough to prevent a user's foot from contacting the ground when the user's feet are positioned within the loops 22, and the user's body is oriented parallel to and above the floor or other support surface. If the user's foot were to rest upon or contact the support surface, this would prevent or impede a rolling of the exercise device 10 along the support surface.

The handle 48 may be constructed of plastic or another suitable material. The handle 48 should be configured such that it is easily gripped and so that the user's hands do not slip off of the exercise device 10 while it is in use.

There are at least three different exercise maneuvers that may be performed using the exercise device 10. In a first maneuver, the user kneels proximate the exercise device 10 and grips the handles 48 on either side of the device 10 with his or her hands. The user rolls the device 10 in front of him or herself along the support surface and away from his or her knees so as to extend his or her body. In the extended position, the body will be oriented substantially parallel to and above the support surface. The user then reverses that motion by pulling the device 10 back toward his or her knees.

In a second maneuver, the user positions his or her hands on the support surface and at least one foot in at least one body-part engagement device. For example, the user may position at least one foot in at least one loop 22 formed by the strap 18. The user then extends at least one leg with the at least one foot to move the exercise device 10 away from his or her body, until his or her body is substantially parallel to the support surface. Alternatively, the user moves his or her hands to propel him or herself, along with the device 10, across the support surface. In other words, the user may use his or her hands to "walk" along the support surface. The user could also flip the device 10 over such that the strap 18 faces the floor. The user could then place his or her knees on the device 10 and extend his or her body substantially parallel to and above the support surface. In this configuration, the user could use his or her hands to "walk" along the support surface.

In a third maneuver, the user positions his or her hands on the support surface and at least one foot in at least one body-part engagement device. For example, the user may position at least one foot in at least one loop 22 formed by the strap 18. While planting his or her hands stationary on the support surface, the user pulls the exercise device 10 with his or her at least one foot to draw the device 10 under the user's body. The user then reverses that motion by using his or her at least one foot to push the device 10 back to an extended position, away from the user's body.

Figure 4:
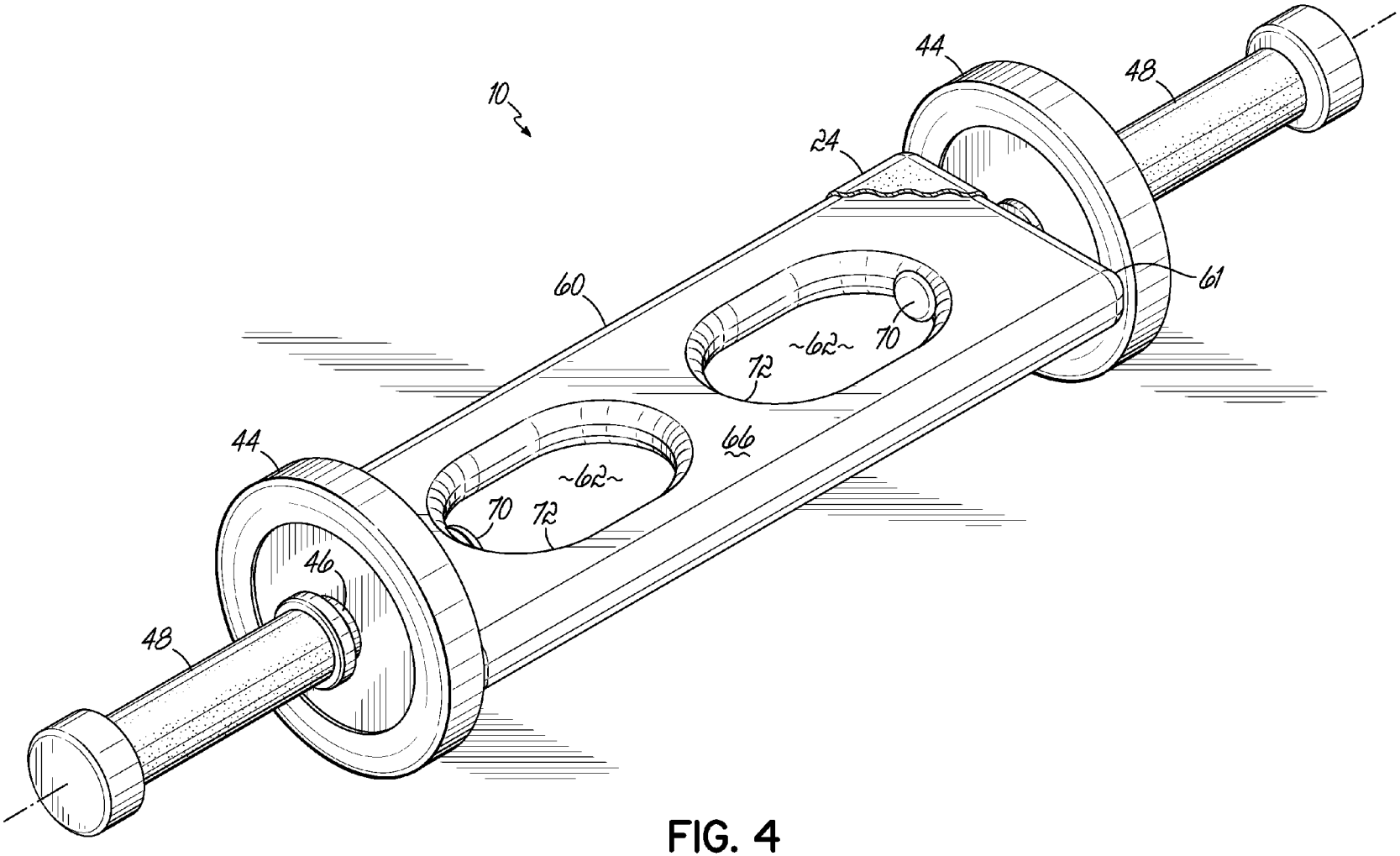
FIG. 4 is a perspective view of an exercise device in accordance with another embodiment of the present invention.
Figure 5:
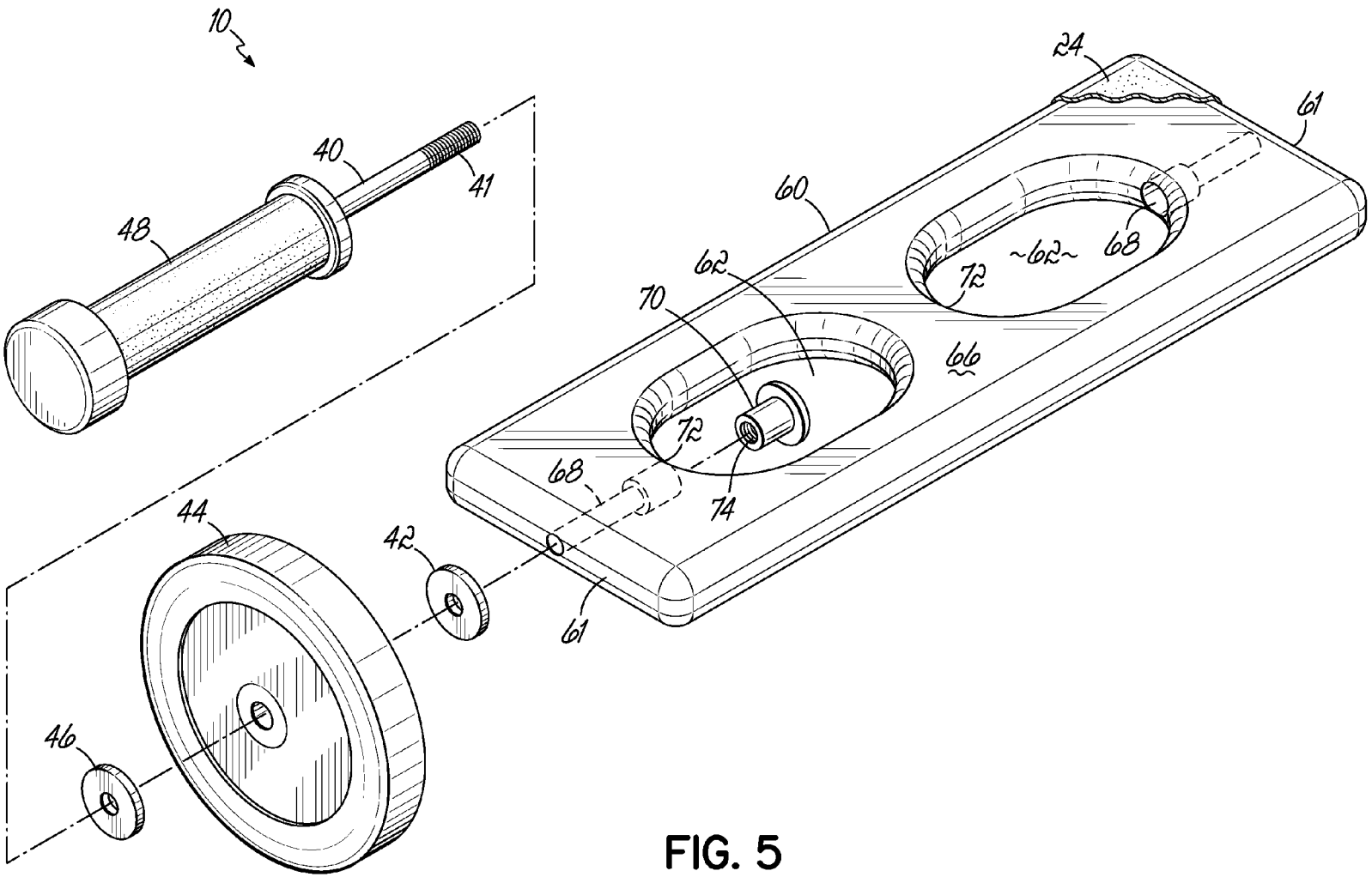
FIG. 5 is an exploded view of the exercise device of FIG. 4.
Figure 6:
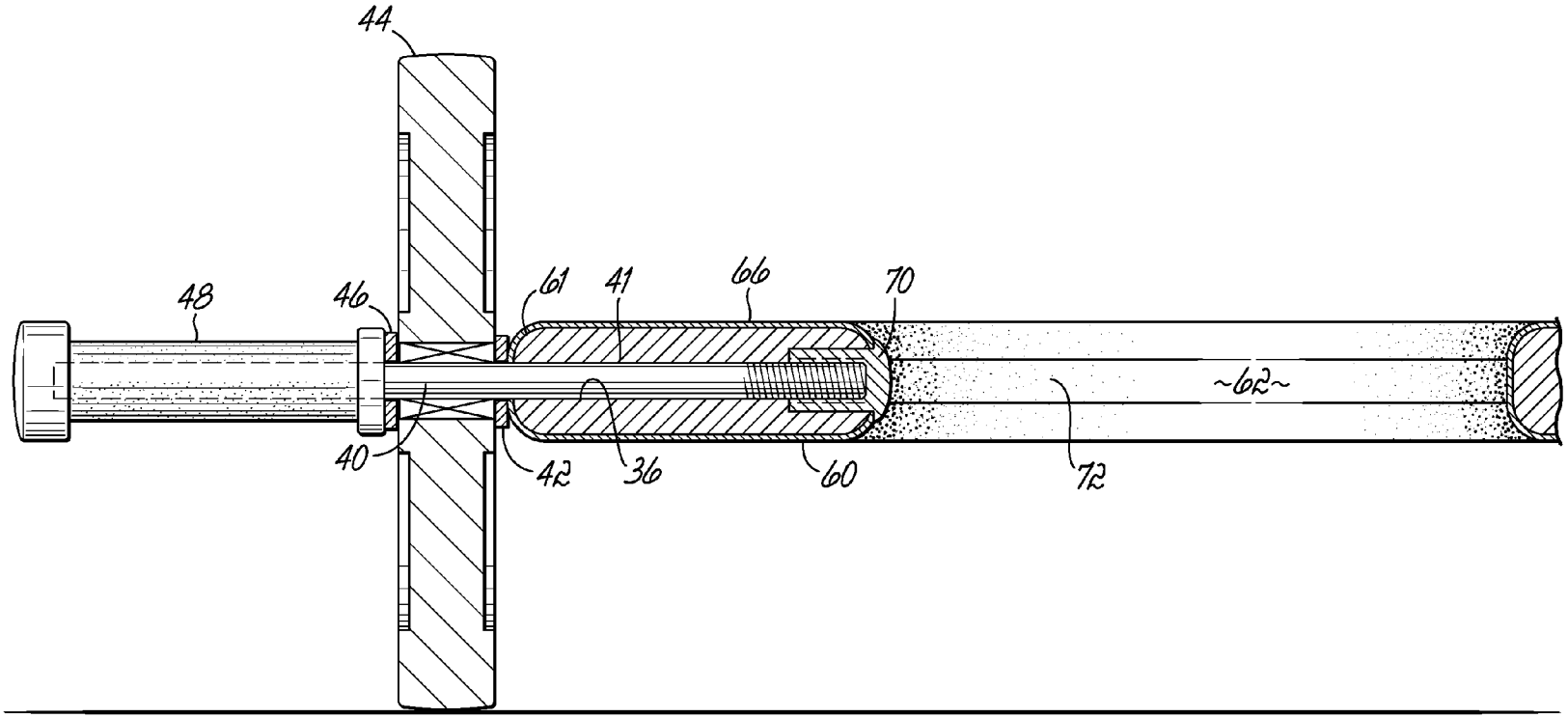
FIG. 6 is a cross-sectional view of the exercise device of FIG. 4.

With reference now to FIGS. 4-6, in another embodiment of the exercise device 10, a beam 60 having two ends 61 and a longitudinal axis extending through the two ends 61, includes at least two spaced-apart holes 62 through an upper face 66 of the beam 60. The beam 60 may be constructed of any suitable structural material, including but not limited to, wood, aluminum, steel, plastic, fiberglass, or composite materials. The holes 62 extend down through the height of the beam and are sized and positioned on the board 60 and serve as a body-part engagement device to receive and engage a user's hands, feet, or knees with the device 10. Therefore, the holes 62 are generally oval-shaped. The holes 62 preferably have rounded edges rather than sharp edges, which could cause discomfort to the user's body parts in the holes. As discussed with respect to FIGS. 2 and 3 above, a padding 24 (partially shown in FIGS. 4 and 5) may cover certain or all faces of the beam 60.

Each end 61 of the beam 60 has a bore 68 extending from the end 61, through the beam 60, and to the hole 62. The bore 68 may have a uniform or non-uniform size along its lengths and may be threaded or non-threaded.

A cap 70 resides adjacent an interior surface 72 of the hole 62. The cap has a threaded bore 74 extending at least partially therethrough. The cap 70 is positioned so that the threaded bore 74 and bore 68 through the beam 60 are coaxially aligned with one another. The cap 70 is shaped so that it does not create a sharp protrusion into the hole 62, which could cause discomfort to the user's body part positioned therein. For example, the cap 70 may have a rounded shape, or it may create a flush surface with the interior surface 72 of the hole 62. The cap 70 may be formed of plastic, wood, a composite, or any other suitable material.

As shown in FIG. 5, a rod 40 with a threaded end 41, similar to that described in use with the beam 12 above, passes through the bore 68 and through the beam 60, so as to threadingly couple with the cap 70 at the hole 62. Therefore, the position of the rod 40 is substantially parallel to the longitudinal axis of the beam 60. At the end 61 of the beam 60, the same arrangement of washers 42, a wheel 44, and a handle 48 is used, as described above. Because the user's feet may be inserted through the holes 62 of the beam 60, the wheels 44 should have a radius sufficiently large that the user's feet do not contact the ground when the user's feet are positioned in the holes 62.

The exercise device 10 including beam 60 may be used to perform the same exercises as described above with respect to the embodiment of the exercise device 10 including beam 12. Rather than positioning the user's feet within the loops 22 or placing the user's knees on a planar surface of the beam 12, the user may position his or her feet or knees within the holes 62 of beam 60 and execute the same exercise movements. In other words, the holes 62 serve as the body part engagement device in this embodiment. Additionally, the user could perform certain exercises, including the first maneuver, by positioning his or her hands so as to grip the beam 60 at the holes 62. Therefore, the user could optionally grip the beam 60 via the holes 62 rather than gripping the handles 48.

Additional exercise maneuvers beyond those described above may be performed with the exercise device 10.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the general inventive concept.

What is claimed is:

1. An exercise device comprising:

a beam having first and second ends, the beam having a longitudinal axis extending through the first and second ends;

first and second rods removeably affixed to respective first and second ends of the beam and extending outwardly from the first and second ends substantially parallel to the longitudinal axis of the beam;

first and second wheels rotatably mounted on respective first and second rods;

first and second handles positioned on outer ends of respective first and second rods; and at least one body-part engagement device associated with the beam including first and second spaced-apart through holes extending through an upper face of the beam, the through holes being sized to receive the hands, feet, or knees of a user.

2. The exercise device of claim 1, wherein at least one exterior surface of the beam is covered with padding.

3. The exercise device of claim 1, wherein a radius of the first and second wheels is sufficiently large to prevent the user's foot from contacting a support surface when the user's foot is positioned in at least one of the first and second through holes in the upper face of the beam.

4. The exercise device of claim 1, wherein the beam has first and second bores extending substantially parallel to the longitudinal axis from respective first and second ends of the beam to the first and second through holes, the device further comprising:

first and second caps, each cap having a threaded bore, the first and second caps residing adjacent interior surfaces of respective first and second through holes;

wherein the first and second rods each have at least one end that is threaded and threadingly engaging the threaded bore of respective first and second caps to secure the first and second rods to the beam.

5. An exercise device comprising:

a beam having first and second ends, the beam having a longitudinal axis extending through the first and second ends and an interior cavity extending substantially the entire length of the beam;

first and second rods removeably affixed to respective first and second ends of the beam and extending outwardly from the first and second ends substantially parallel to the longitudinal axis of the beam;

first and second wheels rotatably mounted on respective first and second rods;

first and second handles positioned on outer ends of respective first and second rods;

at least one body-part engagement device associated with the beam;

first and second end plates affixed to the respective first and second ends of the beam, each end plate having a through hole; and first and second attachment blocks, each attachment block having a threaded bore, the first and second attachment blocks being affixed to respective first and second end plates such that the through hole and threaded bore are coaxially aligned, the attachment blocks positioned within the interior cavity of the beam;

wherein the first and second rods extend through the respective through hole of the first and second end plates and the respective threaded bore of the first and second attachment blocks.

6. The exercise device of claim 5, wherein the first and second rods each have at least one end that is threaded and threadingly engaging the threaded bore of respective first and second attachment blocks.

7. The exercise device of claim 5, wherein the body-part engagement device includes a strap affixed to the beam to form two loops, each loop sized to receive a user's foot.

8. The exercise device of claim 7, wherein a radius of the first and second wheels is sufficiently large to prevent the user's foot from contacting a support surface when the user's foot is positioned in at least one of the loops.

9. A method for exercising using an exercise device having a beam having first and second ends, the beam having a longitudinal axis extending through the first and second ends, first and second rods removeably affixed to respective first and second ends of the beam and extending outwardly from the first and second ends substantially parallel to the longitudinal axis of the beam, first and second wheels rotatably mounted on respective first and second rods, first and second handles positioned on outer ends of respective first and second rods, and at least one body-part engagement device associated with the beam including first and second spaced-apart through holes extending through an upper face of the beam, the through holes being sized to receive the hands of a user, the method comprising:

kneeling proximate the exercise device;

gripping at least one of the first and second handles of the device or the beam at the first and second through holes with the user's hands;

rolling the device along a support surface away from the user's knees so as to extend the body; and pulling the device back toward the user's knees.

10. A method for exercising using an exercise device having a beam having first and second ends, the beam having a longitudinal axis extending through the first and second ends, first and second rods removeably affixed to respective first and second ends of the beam and extending outwardly from the first and second ends substantially parallel to the longitudinal axis of the beam, first and second wheels rotatably mounted on respective first and second rods, and at least one body-part engagement device associated with the beam including first and second spaced-apart through holes extending through an upper face of the beam, the through holes being sized to receive the feet of a user, the method comprising:

positioning at least one of the user's feet in the at least one body-part engagement device;

extending at least one of the user's legs with the at least one of the user's feet to move the exercise device away from the user's body until the body is substantially parallel to a support surface; and alternatively moving the user's hands to propel the user and the device across the support surface.

11. A method for exercising using an exercise device having a beam having first and second ends, the beam having a longitudinal axis extending through the first and second ends, first and second rods removeably affixed to respective first and second ends of the beam and extending outwardly from the first and second ends substantially parallel to the longitudinal axis of the beam, first and second wheels rotatably mounted on respective first and second rods, and at least one body-part engagement device associated with the beam including first and second spaced-apart through holes extending through an upper face of the beam, the through holes being sized to receive the feet of a user, the method comprising:

positioning at least one of the user's feet in the at least one body-part engagement device;

placing the user's hands on a support surface and holding them stationary;

pulling the exercise device with the at least one of the user's feet to draw the exercise device under the user's body; and pushing the exercise device with the at least one of the user's feet and away from the user's body.

12. An exercise device comprising:

a beam having first and second ends, the beam having a longitudinal axis extending through the first and second ends;

first and second rods removeably affixed to respective first and second ends of the beam and extending outwardly from the first and second ends substantially parallel to the longitudinal axis of the beam;

first and second wheels rotatably mounted on respective first and second rods; and at least one body-part engagement device associated with the beam including first and second spaced-apart through holes extending through an upper face of the beam, the through holes being sized to receive the hands, feet, or knees of a user.

* * * * *

UNITED STATES PATENT AND TRADEMARK OFFICE

CERTIFICATE OF CORRECTION

PATENT NO. : 8,814,767 B2
APPLICATION NO. : 13/278574
DATED : August 26, 2014
INVENTOR(S) : Ralph R. Brodbeck It is certified that error appears in the above-identified patent and that said Letters Patent is hereby corrected as shown below:

On the Title Page,

Related U.S. Application Data is missing. Please insert item (60), --Provisional Application No. 61/405,318, filed on October 21, 2010.--

Signed and Sealed this
Second Day of December, 2014

Michelle K. Lee

Michelle K. Lee
*Deputy Director of the United States Patent and Trademark Office*